US007560420B2

(12) United States Patent
Kinker et al.

(10) Patent No.: US 7,560,420 B2
(45) Date of Patent: Jul. 14, 2009

(54) OIL COMPOSITION FOR LUBRICATING AN EGR EQUIPPED DIESEL ENGINE AND AN EGR EQUIPPED DIESEL ENGINE COMPRISING SAME

(75) Inventors: Bernard Kinker, Kintersville, PA (US); Matthias Fischer, Worms (DE); Martin Bollinger, N. Wales, PA (US); Robert Cybert, Roosevelt, NJ (US); Ernst Bielmeier, Griesheim (DE); David Cooper, Quakertown, PA (US); Angelika Fischer, Dreieich (DE); Melanie Croessmann, Ober-Ramstadt (DE)

(73) Assignee: RohMax Additives GmbH, Darmstadt (DE)

( * ) Notice: Subject to any disclaimer, the term of this patent is extended or adjusted under 35 U.S.C. 154(b) by 327 days.

(21) Appl. No.: 11/019,256

(22) Filed: Dec. 23, 2004

(65) Prior Publication Data

US 2006/0142168 A1 Jun. 29, 2006

(51) Int. Cl.
*C10M 145/14* (2006.01)

(52) U.S. Cl. ..... 508/470; 508/466; 508/469

(58) Field of Classification Search ..... 508/466, 508/469, 470
See application file for complete search history.

(56) References Cited

U.S. PATENT DOCUMENTS

| | | | | |
|---|---|---|---|---|
| 3,816,315 | A * | 6/1974 | Morduchowitz et al. | 508/470 |
| 4,021,357 | A * | 5/1977 | Morduchowitz et al. | 508/471 |
| 5,571,950 | A * | 11/1996 | Waddoups et al. | 73/53.05 |
| 5,665,685 | A * | 9/1997 | Takigawa | 508/421 |
| 2004/0048753 | A1 * | 3/2004 | Ritchie et al. | 508/232 |

FOREIGN PATENT DOCUMENTS

GB 2355466 A * 4/2001

* cited by examiner

*Primary Examiner*—Glenn Caldarola
*Assistant Examiner*—Jim Goloboy
(74) *Attorney, Agent, or Firm*—Oblon, Spivak, McClelland, Maier & Neustadt, P.C.

(57) ABSTRACT

The present invention is directed to a lubricating oil composition, a diesel engine comprising a lubricating oil composition, and a method of lubricating a diesel engine provided with an exhaust gas recirculation system, comprising lubricating said engine with a lubricating oil composition comprising an oil of lubricating viscosity, and a polymeric N-dispersant booster.

9 Claims, No Drawings

OIL COMPOSITION FOR LUBRICATING AN EGR EQUIPPED DIESEL ENGINE AND AN EGR EQUIPPED DIESEL ENGINE COMPRISING SAME

BACKGROUND OF THE INVENTION

1. Field of the Invention

The present invention relates to a lubricating oil composition for diesel engines provided with an exhaust gas recirculation (EGR) system, a diesel engine provided with an EGR system comprising a lubricating oil composition, a method of lubricating a diesel engine provided with an EGR system and a method of screening a lubricating oil composition for effectiveness in lubricating a diesel engine provided with an EGR system. More particularly, the present invention relates to compression ignited internal combustion engines equipped with EGR systems in which intake air and/or exhaust gas recirculation streams are cooled below the dew point during operation (condensation mode), lubricated with a lubricating oil composition that provides acceptable performance over time in such an engine.

2. Discussion of the Background

Environmental concerns have led to continued efforts to reduce $NO_x$ emissions of compression ignited (diesel) internal combustion engines. The latest technology being used to reduce the $NO_x$ emissions of heavy duty diesel engines is known as exhaust gas recirculation or EGR. EGR reduces $NO_x$ emissions by introducing non-combustible components (exhaust gas) into the incoming air-fuel charge introduced into the engine combustion chamber. This reduces peak flame temperature and $NO_x$ generation. In addition to the simple dilution effect of the EGR, an even greater reduction in $NO_x$ emission is achieved by cooling the exhaust gas before it is returned to the engine. The cooler intake charge allows for better filling of the cylinder, and thus, improved power generation. In addition, because the EGR components have higher specific heat values than the incoming air and fuel mixture, the EGR gas further cools the combustion mixture leading to greater power generation and better fuel economy at a fixed $NO_x$ generation level.

Diesel fuel contains sulfur. In the United States today, even low sulfur diesel fuel may contain as much as 500 ppm sulfur, whereas European diesel fuel generally contains amounts of the order of 50 ppm. When fuel is burned in the engine, sulfur is converted to $SO_x$. In addition, one of the major by-products of the combustion of a hydrocarbon fuel is water vapor. Therefore, the exhaust stream contains some level of $NO_x$, $SO_x$ and water vapor. In the past, the presence of these substances has not been problematic because the exhaust gases remained extremely hot, and these components were exhausted in a disassociated, gaseous state. However, when the engine is equipped with an EGR, and the EGR stream is cooled before it is returned to the engine, the $NO_x$, $SO_x$, water vapor mixture is cooled below the dew point, causing the water vapor to condense. This water reacts with the $NO_x$ and $SO_x$ components to form a mist of nitric and sulfuric acids in the EGR stream.

In the presence of these acids, it has been found that soot levels in lubricating oil compositions can build rapidly, and that under such conditions, the kinematic viscosity (kv) of lubricating oil compositions increases more rapidly to unacceptable levels, even in the presence of relatively small levels of soot (e.g., 3 wt. % soot). Because an increased lubricant viscosity can adversely affect performance, and can even cause engine failure, the use of an EGR system that operates in a condensing mode during at least a portion of the operating time, requires frequent lubricant replacement. API-CI-4 oils developed specifically for EGR equipped engines that operate in a condensing mode have been found to be unable to address this problem. It has also been found that simply adding additional conventional dispersant is ineffective in reducing this viscosity growth.

Therefore, it would be advantageous to identify lubricating oil compositions that better perform in diesel engines equipped with EGR systems. Surprisingly, it has been found that by selecting certain additives, specifically certain viscosity modifiers and/or detergents, the rapid increase in lubricant viscosity associated with the use of engines provided with EGR systems that operate in a condensing mode can be ameliorated.

Traditionally heretofore, in addition to normal dispersant components, polymeric boosters such as N-dispersants VI improvers (e.g. Viscoplex series 6 polymers) have been added. (e.g. U.S. Pat. No. 4,290,925, U.S. Pat. No. 3,142,664, SAE 2003-01-1959, SAE 2002-01-1671, SAE 2000-01-1988) The reasoning for adding such N-dispersants was that oxidation occurs in the diesel engine which also creates acidic components. However, such acidic components are of a different chemical nature and quantity than those produced by a cooled EGR engines.

Ritchie et al. U.S. Pat. No. 6,715,473 describes an EGR equipped diesel engine and lubricating oil composition lubricating same.

Ritchie et al. US 2004/0485753 describes a lubricating oil composition containing less than 0.3% sulfur and comprising (a) a major amount of oil of lubrication viscosity, (b) an amount of nitrogen containing dispersant contributing no more than about 3.5 mmols of nitrogen per 100 grams of oil, wherein greater than 50 wt. % of the total amount of dispersant nitrogen is nonbasic and (c) one or more detergents, wherein about 60% to 100% of the total amount of the detergent surfactant is phenate and/or salicylate.

Seebauer et al. U.S. Pat. Nos. 6,124,249 and 6,271,184 describe viscosity improvers for lubricating oil compositions comprising:

a) $C_{13-19}$ polyalkyl(meth)acrylates (PAMA);
b) $C_{7-12}$ PAMA (branched with 2-$C_{1-4}$ groups), and
c) optionally c1) $C_{2-8}$ PAMA or c2) vinyl aromatic compounds and nitrogen containing vinyl monomers with <60% of the ester groups containing not more than 11 carbon atoms.

The use of the polymer is in a gear oil formulation, mainly useful for continuous variable transmission fluids.

U.S. Pat. No. 5,571,950 describes a method for testing for soot-related viscosity increase, comprising: (1a) obtaining a sample which comprises a major amount of an oil of lubricating viscosity; (1b) measuring the viscosity of the oil; (1c) preparing a stable sample/paste dispersion of the sample and carbon black paste; (1d) equilibrating the sample/paste dispersion; and (1e) measuring the viscosity of the sample paste dispersion, wherein shear is added to mimic the shear effects of an engine environment at any time after said step (a).

EP 937769 describes a copolymer comprising units derived from (a) methacrylic acid esters containing from about 9 to about 25 carbon atoms in the ester group and (b) methacrylic acid esters containing from 7 to about 12 carbon atoms in the ester group, said ester groups having 2-($C_{1-4}$ alkyl)-substituents, and optionally (c) at least one monomer selected from the group consisting of methacrylic acid esters containing from 2 to about 8 carbon atoms in the ester group atoms and which are different from methacrylic acid esters (a) and (b), vinyl aromatic compounds, and nitrogen-containing vinyl monomers with the proviso that no more than 60% by weight of the esters contain not more than 11 carbon atoms in the ester group. Also described are additive concentrates and lubricating oil compositions containing the copolymers and processes for preparing copolymers.

EP 0,750,031 describes a copolymer comprising:

a) 5-75 wt % $C_{1-11}$ PAMAs;

b) 25-95 wt % $C_{12-24}$ PAMAs; and c) 0.1-20 wt % N-dispersants.

U.S. Pat. No. 6,323,164 B1 describes a) 12-18% $C_1$ PAMA; b) 75-85% $C_{10-15}$ PAMA; and c) 2-5% N-dispersant monomers.

U.S. Pat. No. 4,867,894 describes a statistical PAMA-copolymer of Mw 50,000-500,000 with a) 10-30 mol % $C_1$-PAMA; b) 10-70 mol % $C_{16-30}$ PAMA; c) 10-80 mol % $C_{4-15}$ PAMA; and d) 0-30 mol % oxygen or nitrogen dispersant as pour point depressants.

U.S. Pat. No. 4,968,444 describes a binary combination of statistical PAMA-copolymers I/II with I) 10-98 mol % $C_{6-15}$; 1b) 0-5 mol % $C_{16-30}$ PAMA; c) 0-90 mol % $C_{8-40}$ PAMA; Id) 0-50 mol % $C_{1-5}$ PAMA; and Ie) 2-20% oxygen or nitrogen dispersant PAMA; and II) IIa) 0-90 mol % $C_{6-15}$; IIb) 10-70 mol % $C_{16-30}$ PAMA; IIc) 0-90 mol % $C_{8-40}$ PAMA;

IId) 0-50 mol % $C_{1-5}$ PAMA; and IIe) 0-20% oxygen or nitrogen dispersant PAMA.

EP 439,254 describes an oil-soluble polymer, which comprises, as polymerized monomers, monomers selected from (a) alkylmethacrylates in which the alkyl group contains from 1 to 4 carbon atoms; (b) alkyl methacrylates in which the alkyl group contains from 10-15 carbon atoms; (c) alkyl methacrylates in which the alkyl group contains from 16 to 20 carbon atoms; and (d) N,N-dialkylaminoalkyl methacrylamides; and wherein said polymer contains:

i) 0-5% of (a); 74-97% of (b); ≦15% of (c); and 2-6% of (d) or ii) <15% (a); 79-97% (b); and 2-6% (d).

The target is a fluid for internal combustion engines or automatic transmission fluids.

U.S. Pat. No. 4,021,357 describes a) 15-25% $C_{1-5}$ PAMA; b) 62-40% $C_{10-15}$ PAMA; c) 20-25% $C_{16-20}$ PAMA; and (d) 3-10% N,N-dialkyl-aminoalkyl-methacrylamide. The target is fluid for internal combustion engines or automatic transmission fluids.

U.S. Pat. No. 5,756,433 describes a comb polymer, made via the macromonomer route from a) 0-90 mol % $C_{6-30}$ PAMA; b) 0-60% $C_{1-5}$ PAMA or Styrene or $C_{1-4}$ alyklstyrene or $C_{2-12}$ vinylesters of Carboxylic acids; and d) a "dispersion effective" amount of dispersant comonomers.

U.S. Pat. No. 5,843,874 describes a gear oil formulation comprising 0.1-10 wt % of polymer, said polymer consisting of a) 0-50 wt. % $C_{1-6}$ PAMA; b) 30-85 wt. % $C_{7-14}$ PAMA; c) 3-50 wt. % of $C_{15-20}$ PAMA; and d) 2-10 wt. % N,N-diaminoalkyl(meth)acrylamide.

U.S. Pat. No. 5,622,924 describes $C_{1-C10}$ PAMA >70%, preferred 2-Ethyl-hexylmethacrylate; $C_{11-20}$ PAMA <30%, or other monomers.

EP 228,922 describes styrene (vinylaromatic Monomer) 10-35%; AMA=65-90%; $C_{1-4}$ PAMA 5-15%; $C_{8-14}$ PAMA 20-55%; $C_{16-22}$ PAMA 15-50%.

U.S. Pat. No. 4,136,047 describes a lauryl-methacrylate=70-90%, styrene=10-30% composition.

U.S. Pat. No. 5,851,967 describes a graft copolymer, comprising:

92-28% of a polymer backbone, derived from 65-95 wt % $C_{1-24}$ alkyl(meth)acrylate;

5-35 wt % styrenic monomer; and 2-8% branches grafted onto the backbone derived from (exclusively) $C_{2-8}$ hydroxyalkyl(meth)acrylate.

U.S. Pat. No. 6,228,819 describes a method of making a viscosity index improver, comprising a) 5-70% $C_{16-24}$ alkyl (meth)acrylate (AMA); b) 5-85% $C_{7-15}$ AMA; c) 5-50% styrene; and d) 2-20% of a mix of (a) and (b).

JP 84020715 describes a polymer comprising:

a) 40-75% polymer 1, deriving from 0-80% $C_{8-15}$ AMA;

20-100% $C_{16-28}$ AMA; and b) 25-60% styrene.

The traditional polymeric N-dispersant boosters are not entirely effective in diesel engines equipped with EGR systems. Using traditional polymeric N-dispersant boosters, increases in oil viscosity are observed at lower soot concentrations, necessitating more frequent oil changes. It was therefore desirable to develop new boosters that can handle the soot and acidic compounds which are present in higher in amounts and are different in chemical nature.

SUMMARY OF THE INVENTION

In accordance with a first aspect of the invention, there is provided a lubricating oil composition comprising an oil of lubricating viscosity and a polymeric dispersant booster comprising:

(i) a polymeric dispersant booster comprising monomer units of:

a) 0 to 40 wt. % of one or more ethylenically unsaturated ester compounds of formula (I)

(I)

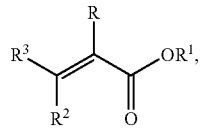

wherein R is equal to H or $CH_3$, $R^1$ represents a linear or branched alkyl group with 1 to 5 carbon atoms, $R^2$ and $R^3$ independently represent H or a group of the formula —COOR', wherein R' is H or an alkyl group with 1 to 5 carbon atoms, b) 10 to 98 wt. % of one or more ethylenically unsaturated ester compounds of formula (II)

(II)

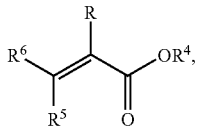

wherein R is equal to H or $CH_3$, $R^4$ represents a linear or branched alkyl group with 6 to 15 carbon atoms, $R^5$ and $R^6$ independently represent H or a group of the formula —COOR", wherein R" is H or an alkyl group with 6 to 15 carbon atoms, c) 0 to 30 wt. % of one or more ethylenically unsaturated ester compounds of formula (III)

(III)

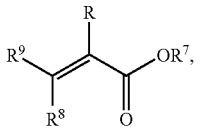

wherein R is equal to H or $CH_3$, $R^7$ represents a linear or branched alkyl group with 16 to 30 carbon atoms, $R^8$ and $R^9$ independently represent H or a group of the formula —COOR'", wherein R'" is H or an alkyl group with 16 to 30 carbon atoms, d) 0 to 30 wt. % vinyl monomers, e) 7 to 25 wt. % of at least one N-dispersant monomer, wherein a)-e) add up to 100 wt. %; and (ii) an oil of lubricating viscosity.

According to a second aspect of this invention is a method of lubricating a diesel engine equipped with an EGR system.

According to a third aspect of this invention is a diesel engine comprising a lubricating oil composition.

According to a fourth aspect of this invention is a method of screening a lubricating oil composition for effectiveness in lubricating a diesel engine provided with an EGR system.

According to a fifth aspect of this invention is a lubricating oil composition comprising an oil of lubricating viscosity and a polymeric dispersant booster comprising:

(i) a polymeric dispersant booster comprising monomer units of:

a) 0 to 40 wt. % of one or more ethylenically unsaturated ester compounds of formula (I)

(I)

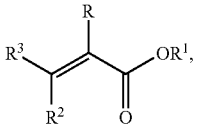

wherein R is equal to H or $CH_3$, $R^1$ represents a linear or branched alkyl group with 1 to 5 carbon atoms, $R^2$ and $R^3$ independently represent H or a group of the formula —COOR', wherein R' is H or an alkyl group with 1 to 5 carbon atoms, b) 10 to 98 wt. % of one or more ethylenically unsaturated ester compounds of formula (II)

(II)

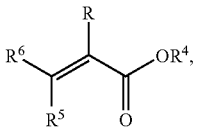

wherein R is equal to H or $CH_3$, $R^4$ represents a linear or branched alkyl group with 6 to 15 carbon atoms, $R^5$ and $R^6$ independently represent H or a group of the formula —COOR", wherein R"

is H or an alkyl group with 6 to 15 carbon atoms, c) 0 to 30 wt. % of one or more ethylenically unsaturated ester compounds of formula (III)

(III)

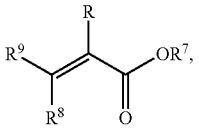

wherein R is equal to H or $CH_3$, $R^7$ represents a linear or branched alkyl group with 16 to 30 carbon atoms, $R^8$ and $R^9$ independently represent H or a group of the formula —COOR'", wherein R'" is H or an alkyl group with 16 to 30 carbon atoms, d) 5 to 30 wt. % vinyl monomers, e) 4 to 25 wt. % of at least one N-dispersant monomer, wherein a)-e) add up to 100 wt. %; and (ii) an oil of lubricating viscosity.

DETAILED DESCRIPTION OF THE PREFERRED EMBODIMENTS

Within the context of the present invention, the term "alkyl (meth)acrylate" refers to both the alkyl acrylate and the alkyl methacrylate species or a mixture thereof.

Monomer a) when present, may be a $C_{1-5}$ alkyl (meth) acrylate or di $C_{1-5}$ alkyl fumarate.

Non-limiting examples of component a) include (meth) acrylates, fumarates and maleates, which derive from saturated alcohols such as methyl (meth)acrylate, ethyl (meth) acrylate, n-propyl (meth)acrylate, isopropyl (meth)acrylate, n-butyl (meth)acrylate, tert-butyl (meth)acrylate and pentyl (meth)acrylate; cycloalkyl (meth)acrylates, like cyclopentyl (meth)acrylate; (meth)acrylates that derive from unsaturated alcohols like 2-propynyl (meth)acrylate, allyl (meth)acrylate and vinyl (meth)acrylate or dimethylfumarate.

Monomer a) is present in an amount of 0-40 wt. %, preferably 0-20 wt. % based on the total weight of components a), b), c), d) and e).

In one embodiment, the amount of monomer a) is at least 0.5 wt. %, preferably at least 1 wt. %.

Monomer b) may be a $C_{6-15}$ alkyl (meth)acrylate or di $C_{6-15}$ alkyl fumarate, such as butyl methacryalte, butyl acrylate, or dibutylfumarate.

Non-limiting examples of component b) include (meth) acrylates, fumarates and maleates that derive from saturated alcohols, such as hexyl (meth)acrylate, 2-ethylhexyl (meth) acrylate, heptyl (meth)acrylate, 2-tert-butylheptyl (meth) acrylate, octyl (meth)acrylate, 3-isopropylheptyl (meth)acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate; (meth)acrylates that derive from unsaturated alcohols, such as oleyl (meth) acrylate; cycloalkyl (meth)acrylates such as 3-vinylcyclohexyl (meth)acrylate, cyclohexyl (meth)acrylate, bornyl (meth)acrylate; and the corresponding fumarates and maleates.

Monomer b) is present in an amount of 10-98 wt. %, preferably 20-80 wt. %, more preferably 25-60 wt. % based on the total weight of components a), b), c), d) and e). A particularly preferred amount of monomer b) is 25-98 wt. % based on the total weight of components a), b), c), d) and e).

In a preferred embodiment, monomer b) is a $C_{8-15}$ alkyl (meth)acrylate, preferably commercial lauryl(meth)acrylate or a $C_{10-15}$ alkyl (meth)acrylate fraction. More preferably the backbone monomer is a $C_{8-15}$ alkyl methacrylate, preferably commercial laurylmethacrylate or a $C_{10-15}$ alkyl methacrylate fraction.

Monomer c) when present, may be a $C_{16-30}$ alkyl (meth) acrylate or di $C_{16-30}$ alkyl fumarate.

Non-limiting examples of component (c) include (meth) acrylates that derive from saturated alcohols, such as hexadecyl (meth)acrylate, 2-methylhexadecyl (meth)acrylate, heptadecyl (meth)acrylate, 5-isopropylheptadecyl (meth) acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth) acrylate, eicosyl (meth)acrylate, cetyleicosyl (meth)acrylate, stearyleicosyl (meth)acrylate, docosyl (meth)acrylate, and/or eicosyltetratriacontyl (meth)acrylate; cycloalkyl (meth)acrylates such as 2,4,5-tri-t-butyl-3-vinylcyclohexyl (meth)acrylate, 2,3,4,5-tetra-t-butylcyclohexyl (meth)acrylate; oxiranyl methacrylates such as 10,11-epoxyhexadecyl methacrylate; as well as the corresponding fumarates and maleates.

Monomer c) is present in an amount of 0-30 wt. % based on the total weight of components a), b), c), d) and e).

In one embodiment, the amount of monomer c) is at least 0.5 wt. %, preferably at least 1 wt. %.

Monomer d), when present may be a vinyl aromatic monomer such as styrene and substituted styrenes although other vinyl monomers can also be used. The substituted styrenes include styrenes that have halo-, amino-, alkoxy-, carboxy-, hydroxy-, sulfonyl-, hydrocarby—wherein the hydrocarbyl group has from 1 to about 12 carbon atoms and other substituents. Exemplary of the hydrocarbyl-substituted styrenes are α-methylstyrene, para-tert-butylstyrene, α-ethylstyrene, and para-lower alkoxy styrene. Mixtures of two or more vinyl monomers can be used. Styrene is preferred.

The amount of vinyl monomer used is from 0 to 30 wt. %, and when present, preferably from 5-25 wt. %, more preferably 10-20 wt. %, based on the total weight of components a), b), c), d) and e).

Monomer e) is at least one monomer selected from the group consisting of N-vinylic monomers, (meth)acrylic esters, (meth)acrylic amides, (meth)acrylic imides each with dispersing moieties in the side chain and may be an N-dispersant monomer of the formula

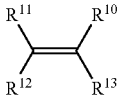

wherein $R^{10}$, $R^{11}$ and $R^{12}$ independently are H or an alkyl group with 1 to 5 carbon atoms and $R^{13}$ is either a group C(Y)X—$R^{14}$ with X=0 or X=NH and Y is (=O) or (=$NR^{15}$), where $R^{15}$ is an alkyl or aryl group, and $R^{14}$ represents a linear or branched alkyl group with 1 to 20 carbon atoms which is substituted by a group $NR^{16}R^{17}$ where $R^{16}$ and $R^{17}$ independently represent H or a linear or branched alkyl group with 1 to 8 carbon atoms, or wherein $R^{16}$ and $R^{17}$ are part of a 4 to 8 membered saturated or unsaturated ring containing optionally one or more hetero atoms chosen from the group consisting of nitrogen, oxygen or sulfur, wherein said ring may be further substituted with alkyl or aryl groups, or $R^{13}$ is a group $NR^{18}R^{19}$, wherein $R^{18}$ and $R^{19}$ are part of a 4 to 8 membered saturated or unsaturated ring, containing at least one carbon atom as part of the ring which forms a double bond to a hetero atom chosen from the group consisting of nitrogen, oxygen or sulfur, wherein said ring may be further substituted with alkyl or aryl groups.

In one embodiment, $R^{14}$ represents H or a linear or branched alkyl group with 2 to 6 carbon atoms.

Non-limiting examples of N-dispersant monomers include those selected from the group consisting of vinyl substituted nitrogen heterocyclic monomers, for example vinyl pyridine and N-vinyl-substituted nitrogen heterocyclic monomers, for example, N-vinyl imidazole, N-vinyl pyrrolidinone (NVP), morpholinoethyl methacrylate and N-vinyl caprolactam, dialkylaminoalkyl acrylate and methacrylate monomers, for example N,N-dialkylaminoalkyl acrylates, for example N,N-dimethylaminoethyl methacrylate (DMAEMA), tert-butyl aminoethyl methacrylate, dialkylaminoalkyl acrylamide and methacrylamide monomers, for example di-lower alkylaminoalkylacrylamide, especially where each alkyl or aminoalkyl group contains from 1 to about 8 carbon atoms, especially from 1 to 3 carbon atoms, for example N,N-di lower alkyl, especially, N,N-dimethylaminopropylmethacrylamide (DMAPMAM), dimethylaminopropylacrylamide, dimethylaminoethylacrylamide, N-tertiary alkyl acrylamides and corresponding methacrylamides, for example tertiary butyl acrylamide, vinyl substituted amines, and N-vinyl lactam such as N-vinyl pyrrolidinone. Preferably, the N-dispersant monomer is at least one of dimethylaminopropylmethacrylamide, dimethylaminoethylmethacrylamide, dimethylaminopropylacrylamide, dimethylaminoethylacrylamide, morpholinoethyl methacrylate, and tert-butyl aminoethylmethacrylate, most preferably dimethylaminopropylacrylamide.

The N-dispersant monomer may specifically be at least one monomer selected from the group consisting of N-vinyl pyrrolidinone, N,N-dimethylaminoethyl methacrylate, N,N-dimethylaminopropylmethacrylamide.

By virtue to the presence of basic nitrogen groups in the polymer, it is readily apparent that some or all of the nitrogen atoms may be converted to a salt form by reaction with an acid. Accordingly, the polymeric dispersant booster may be partially or completely neutralized by reaction with acidic compounds and still be within the scope of the invention.

In another embodiment, the N-dispersant monomer may comprise a combination of acrylamide based N-dispersant monomer of the formula

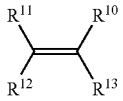

wherein $R^{10}$, $R^{11}$ and $R^{12}$ independently are H or an alkyl group with 1 to 5 carbon atoms and $R^{13}$ is either a group C(Y)X—$R^{14}$ with X═O or X═NH and Y is (═O) or (═$NR^{15}$), where $R^{15}$ is an alkyl or aryl group, and $R^{14}$ represents a linear or branched alkyl group with 1 to 20 carbon atoms which is substituted by a group $NR^{16}R^{7}$ where $R^{16}$ and $R^{17}$ independently represent H or a linear or branched alkyl group with 1 to 8 carbon atoms, or wherein $R^{16}$ and $R^{17}$ are part of a 4 to 8 membered saturated or unsaturated ring containing optionally one or more hetero atoms chosen from the group consisting of nitrogen, oxygen or sulfur, wherein said ring may be further substituted with alkyl or aryl groups, and an N-dispersant monomer of the formula

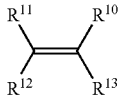

wherein $R^{10}$, $R^{11}$ and $R^{12}$ independently are H or an alkyl group with 1 to 5 carbon atoms and $R^{13}$ is a group $NR^{18}R^{19}$, wherein $R^{18}$ and $R^{19}$ are part of a 4 to 8 membered saturated or unsaturated ring, containing at least one carbon atom as part of the ring which forms a double bond to a hetero atom chosen from the group consisting of nitrogen, oxygen or sulfur, wherein said ring may be further substituted with alkyl or aryl groups, in amounts of up to 10 wt. %, preferably up to 4 wt. % based on the total weight of the polymeric dispersant booster, the total amount of N-dispersant monomer not exceeding 25 wt. % based on the total weight of the polymeric dispersant booster.

Preferably the monomer where $R^{13}$ is a group $NR^{18}R^{19}$, is N-vinyl pyrrolidinone.

The amount of N-dispersant monomer is typically from 7-25 wt. %, preferably from 10-25 wt. %, more preferably 10-20 wt. %, even more preferably 15-20 wt. % based on the total weight of components a), b), c), d) and e).

It may be beneficial to use at least two N-dispersant monomers, especially when the total amount of N-dispersant monomer is at the low end of the recited range.

In another embodiment, the polymeric dispersant booster may be comprised of:

0-40 wt. % monomer a);

10-98 wt. % of monomer b);

0-30 wt. % of monomer c);

5-30 wt. % of monomer d); and 4-25 wt. % of monomer e), wherein a)-e) add up to 100 wt. %, where monomers a)-e) are as described above. In this embodiment the amount of monomer e) may be reduced by ensuring the presence of monomer d).

The polymeric dispersant booster typically will have a number average molecular weight Mn of from 5,000-1,000,000, preferably 25,000 to 1,000,000 as measured by size exclusion chromatography, calibrated versus a polystyrene standard.

Alternatively, the polymeric dispersant booster typically will have a shear stability from 2-55% as measure by the 20 hour KRL shear stability test (CEC 45-T-53).

The monomer mixtures described above can be polymerized by methods known in the art. The copolymers of this invention may be prepared by processes comprising reacting, in the presence of a free radical initiator, monomers a-e), optionally in the presence of a chain transfer agent. The monomers may be reacted concurrently.

Conventional radical initiators can be used to perform a classic radical polymerization. These initiators are well known in the art. Examples for these radical initiators are azo initiators like 2,2'-azodiisobutyronitrile (AIBN), 2,2'-azobis (2-methylbutyronitrile) and 1,1-azobiscyclohexane carbonitrile; peroxide compounds, e.g. methyl ethyl ketone peroxide, acetyl acetone peroxide, dilauryl peroxide, tert-butyl per-2-ethyl hexanoate, ketone peroxide, methyl isobutyl ketone peroxide, cyclohexanone peroxide, dibenzoyl peroxide, tert-butyl perbenzoate, tert-butyl peroxy isopropyl carbonate, 2,5-bis(2-ethylhexanoyl-peroxy)-2,5-dimethyl hexane, tert-butyl peroxy 2-ethyl hexanoate, tert-butyl peroxy-3,5,5-trimethyl hexanoate, dicumene peroxide, 1,1-bis(tert-butyl peroxy) cyclohexane, 1,1-bis(tert-butyl peroxy) 3,3,5-trimethyl cyclohexane, cumene hydroperoxide and tert-butyl hydroperoxide.

Low molecular weight poly(meth)acrylates can be obtained by using chain transfer agents. This technology is ubiquitously known and practiced in the polymer industry and is described in Odian, Principles of Polymerization, 1991. Examples of chain transfer agents are sulfur containing compounds such as thiols, e.g. n- and t-dodecanethiol, 2-mercaptoethanol, and mercapto carboxylic acid esters, e.g. methyl-3-mercaptopropionate. Preferred chain transfer agents contain up to 20, especially up to 15 and more preferably up to 12 carbon atoms. Furthermore, chain transfer agents may contain at least 1, especially at least 2 oxygen atoms.

Furthermore, novel polymerization techniques such as ATRP (Atom Transfer Radical Polymerization) and or RAFT (Reversible Addition Fragmentation Chain Transfer) can be applied to obtain useful poly(meth)acrylates. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRP explained above to which reference is expressly made for purposes of the disclosure. The RAFT method is extensively presented in WO 98/01478, for example, to which reference is expressly made for purposes of the disclosure.

The polymerization can be carried out at normal pressure, reduced pressure or elevated pressure. The polymerization temperature is also not critical. However, in general it lies in the range of −20-200° C., preferably 0-130° C. and especially preferably 60-120° C., without any limitation intended by this.

The polymerization can be carried out with or without solvents. The term solvent is to be broadly understood here.

Preferably, the polymerization is carried out in a nonpolar solvent. Among these solvents are hydrocarbon solvents, such as aromatic solvents like toluene, benzene and xylene, saturated hydrocarbons such as cyclohexane, heptane, octane, nonane, decane, dodecane, which can also occur in branched form. These solvents can be used individually and as a mixture. Especially preferred solvents are mineral oils and synthetic oils and mixtures of these. Of these, mineral oils are most preferred.

Mineral oils are substantially known and commercially available. They are generally obtained from petroleum or crude oil by distillation and/or refining and optionally additional purification and processing methods, especially the higher-boiling fractions of crude oil or petroleum fall under the concept of mineral oil. In general, the boiling point of the mineral oil is higher than 200° C., preferably higher than 300° C., at 50 mbar. Preparation by low temperature distillation of shale oil, coking of hard coal, distillation of lignite under exclusion of air as well as hydrogenation of hard coal or lignite is likewise possible. To a small extent, mineral oils are also produced from raw materials of plant origin (for example jojoba, rapeseed oil) or animal origin (for example neatsfoot oil). Accordingly, mineral oils exhibit different amounts of aromatic, cyclic, branched and linear hydrocarbons in each case, according to origin.

In general, one distinguishes paraffin-base naphthenic and aromatic fractions in crude oil or mineral oil, where the term paraffin-base fraction stands for longer-chain or highly branched isoalkanes and naphthenic fraction stands for cycloalkanes. Moreover, mineral oils, in each case according to origin and processing, exhibit different fractions of n-alkanes, isoalkanes with a low degree of branching, so called monomethyl-branched paraffins, and compounds with heteroatoms, especially O, N and/or S, to which polar properties are attributed. The fraction of n-alkanes in the preferred mineral oils is less than 3 wt %, the fraction of O, N and/or S-containing compounds is less than 6 wt %. The fraction of aromatic compounds and monomethyl-branched paraffins is, in general, in each case in the range of 0-30 wt %. In accordance with one interesting aspect, mineral oil comprises mainly naphthenic and paraffin-base alkanes, which generally have more than 13, preferably more than 18 and especially preferably more than 20 carbon atoms. The fraction of these compounds is generally=60 wt %, preferably=80 wt %, without any limitation intended by this.

An analysis of especially preferred mineral oils, which was done with traditional methods such as urea dewaxing and liquid chromatography on silica gel, shows, for example, the following components, where the percentages refer to the total weight of the relevant mineral oil:

n-alkanes with about 18-31 C atoms:

0.7-1.0%, low-branched alkanes with 18-31 C atoms:

1.0-8.0%, aromatic compounds with 14-32 C atoms:

0.4-10.7%, iso- and cycloalkanes with 20-32 C atoms:

60.7-82.4%, polar compounds:

0.1-0.8%, loss:

6.9-19.4%.

Valuable advice regarding the analysis of mineral oil as well as a list of mineral oils that have other compositions can be found, for example, in Ullmann's Encyclopedia of Industrial Chemistry, $5^{th}$ Edition on CD-ROM, 1997, under the entry "lubricants and related products."

Synthetic oils are, among other substances, organic esters, organic ethers like silicone oils and synthetic hydrocarbons, especially polyolefins. They are, for the most part, somewhat more expensive than the mineral oils, but they have advantages with regard to performance. For an explanation one should refer to the 5 API classes of base oil types (API: American Petroleum Institute), and these base oils can especially preferably be used as solvents.

These solvents can be used, among other ways, in an amount of 1-99 wt %, preferably 5-95 wt %, especially preferably 5-60 wt % and most preferably 10-50 wt %, with respect to the total weight of the mixture, without any limitation intended to be implied by this.

In one embodiment, the process comprises reacting a mixture of the monomers, often by first heating a portion, often from about 20% to about 60%, of the mixture until reaction is evident, usually by noting an exotherm, then adding and reacting the balance of the mixture of monomers, either portionwise, or all at once.

The oils of lubricating viscosity useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 4 $mm^2$/sec to about 10 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_{3-8}$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, most preferably at least 85%. Preferably, the oil or oil blend will have a sulfur content of less than 1%, preferably less than 0.6%, most preferably less than 0.3%, by weight.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

Group I base stocks contain less than 90 percent saturates and/or greater than 0.03 percent sulfur and have a viscosity index greater than or equal to 80 and less than 120 using the test methods specified in Table 1.

Group II base stocks contain greater than or equal to 90 percent saturates and less than or equal to 0.03 percent sulfur and have a viscosity index greater than or equal to 80 and less than 120 using the test methods specified in Table 1.

Group III base stocks contain greater than or equal to 90 percent saturates and less than or equal to 0.03 percent sulfur and have a viscosity index greater than or equal to 120 using the test methods specified in Table 1.

Group IV base stocks are polyalphaolefins (PAO).

Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

The viscosity index of the base stock may be increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to about 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

The amount of polymeric dispersant booster added to the oil composition is an amount sufficient to reduce viscosity increases in an EGR equipped diesel engine, typically an amount of at least 0.5 wt. %, more preferably at least 1 wt. %, more preferably at least 2 wt. %, even more preferably at least 3 wt. % based on the total weight of the oil composition.

In one embodiment, the composition comprises 0.5 to 10 wt. % of the polymeric dispersant booster and 70-90 wt. % of the oil of lubricating viscosity.

Preferably, the amount of polymer (i) in the final composition contributes to 0.03 to 0.50 mmols of basic nitrogen per 100 grams of said formulation.

In another embodiment, the lubricating oil composition will have a ΔKV 100° C. of ≦20 cSt, preferably ≦17 cSt, more preferably ≦15 cSt. ΔKV 100° C. is measured as follows:

A 150 mL sample of lubricating oil containing polymeric dispersion booster is oxidized according to CEC-L48-A-00 at a temperature of 160° C., for 72 hours at an air flow rate of 5 L/hr. Carbon Black type S170 (Degussa A G, Hanau-Wolfgang, Germany) is dried overnight at 100° C. To 50 g of oxidized oil was added 5 wt. % of dry carbon black, in a Teflon beaker.

175 g of steel balls (3 mm chromanite-steel balls (Mahlkugeln), (supplier Draiswerke, Mannheim, Germany) were added to the beaker, closed tightly then shaken for 15 minutes with a Red Devil™ paint shaker (from Red Devil Equipment Co. Paint Shaker 5400). The oil sample containing carbon black is separated from the steel balls by using a single use filter and the oil sample containing carbon black is stored for 24 h at ambient temperature. Immediately after stirring for 3 h with a magnetic stirrer, without heating, the oil sample containing carbon black is transferred to a Cannon-Fenske capillary, and allowed to equilibrate in a thermostat to a temperature of 100° C. before measuring KV 100° C. according to DIN 51 366. The difference in the KV 100° C. of the oxidized oil, without the carbon black and the oil sample containing carbon black is the ΔKV 100° C.

In addition to comprising a polymeric dispersant booster containing from 7-25 wt. % of at least one N-dispersant monomer, the oil composition may further comprise traditional oil additives, such as pour point depressants (PPD), otherwise known as lube oil flow improvers (LOFIs) lower the temperature at which the oil composition will still flow. The composition may further comprise from 0.5 to 15 wt. % of a non-dispersant viscosity-improver and/or from 0.5 to 15 wt. % of a detergent inhibitor package. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

Polymers useful as additives are (meth)acrylate or alkyl (meth)acrylate copolymer derivatives having dispersing groups. These polymers have been used as multifunctional dispersant viscosity modifiers in lubricating oil compositions, and lower molecular weight polymers of this type have been used as multifunctional dispersant/LOFIs. Such polymers are commercially available as, for example, Viscoplex 6-954, formerly known as ACRYLOID 954, (a product of RohMax USA Inc.) The acrylate or methacrylate monomers and alkyl acrylate or methacrylate monomers can be prepared from the corresponding acrylic or methacrylic acids or their derivatives. Such acids can be derived using well known and conventional techniques. For example, acrylic acid can be prepared by acidic hydrolysis and dehydration of ethylene cyanohydrin or by the polymerization of β-propiolactone and the destructive distillation of the polymer to form acrylic acid. Methacrylic acid can be prepared by, for example, oxidizing a methyl α-alkyl vinyl ketone with metal hypochlorites; dehydrating hydroxyisobutyric acid with phosphorus pentoxide; or hydrolyzing acetone cyanohydrin.

Alkyl acrylates or methacrylate monomers can be prepared by reacting the desired primary alcohol with the acrylic acid or methacrylic acid in a conventional esterification catalyzed by acid, preferably p-toluene sulfonic acid or methan sulfonic acid and inhibited from polymerization by MEHQ or hydroquinone. Suitable alkyl acrylates or alkyl methacrylates contain from about 1 to about 30 carbon atoms in the alkyl carbon chain. Typical examples of starting alcohols include methyl alcohol, ethyl alcohol, butyl alcohol, octyl alcohol, iso-octyl alcohol, decyl alcoholisodecyl alcohol, undecyl alcohol, dodecyl alcohol, tridecyl alcohol, capryl alcohol, lauryl alcohol, myristyl alcohol, pentadecyl alcohol, palmityl alcohol, stearyl alcohol and eicosyl aclohol. The starting alcohol can be reacted with acrylic acid or methacrylic acid to form the desired acrylates and methacrylates, respectively.

The ester compounds with a long-chain alcohol residue, especially components (b) and (c), can be obtained in another way by reacting (meth)acrylates, fumarates and/or maleates with long chain fatty alcohols, where, in general, a mixture of esters such as (meth)acrylates with different long chain alcohol residues results. These fatty alcohols include, among others, Oxo Alcohol® 7911, Oxo Alcohol® 7900, Oxo Alcohol® 1100, Alfol® 610, Alfol® 810, Lial® 125 and Nafol®-types, (Sasol Olefins & Surfactants GmbH); Alphanol® 79 (ICI); Epal® 610 and Epal® 810 (Ethyl Corporation); Linevol® 79, Linevol® 911 and Neodol® 25E (Shell AG); Dehydad®-, Hydrenol®D- and Lorol®-types (Cognis); Acrpol® 35 and Exxal® 10 (Exxon Chemicals GmbH); Kalcol 2465 (Kao Chemicals).

These acrylate polymers may have number average molecular weights (Mn) of 10,000-1,000,000 and preferably the molecular weight range is from about 200,000-600,000.

To provide an acrylate or methacrylate with a dispersing group, the acrylate or methacrylate monomer is copolymerized with an amine-containing monomer or the acrylate or methacrylate main chain polymer is provided so as to contain sites suitable for grafting and then amine-containing branches are grafted onto the main chain by polymerizing amine-containing monomers.

Examples of amine-containing monomers include the basic amino substituted olefins such as p-(2-diethylaminoethyl) styrene; basic nitrogen-containing heterocycles having a polymerizable ethylenically unsaturated substituent such as the vinyl pyridines or the vinyl pyrrolidinones; esters of amino alcohols with unsaturated carboxylic acids such as dimethylaminoethyl methacrylate and polymerizable unsaturated basic amines such as allyl amine.

The present invention also provides for a method of evaluating the effectiveness of an oil dispersant booster in an EGR equipped diesel engine.

EGR equipped diesel engines provide a difficult task for lubrication. Conventional soot dispersants have not been entirely effective at providing long term lubrication, displaying an increased viscosity, sooner than in conventional diesel engines, and a greater increase in viscosity for the same quantity of soot produced by a conventional diesel engine. However, evidence of effectiveness of an oil dispersant booster in an EGR equipped diesel engine can be time consuming to obtain. Accordingly, a method which is predictive of the behavior of an EGR equipped diesel engine has been developed as follows:

In the method for testing a sample for soot-related viscosity, the sample which comprises a major amount of an oil of lubricating viscosity is prepared and then the viscosity of the sample is measured. Generally, viscosity measurements of the sample are made according to standard practices using any conventional viscometer including a reverse flow viscometer. Suitable viscometers include a Sil viscometer, Cannon-Fenske Routine viscometers, Cannon-Fenske Opaque viscometers, and a Zeitfuchs #4 reverse flow viscometer. The sample which comprises a major amount of oil of lubricating viscosity can include, for example, mineral oils, synthetic oils, and fully formulated oils which contain, for example, dispersants, anti-oxidants, and detergents.

The carbon black dispersion is prepared by mixing a carbon black with the oxidized oil solution and put under conditions of mixing and physical shearing the sample in a ball mill to form a finely dispersed carbon black dispersion with a carbon black agglomerate size of less than about 500 nm, preferably 10 nm to 500 nm, more preferably 10 nm to 180 nm, according to ASTM D 3849.

The nature of carbon black used to test for soot-related viscosity increases in not particularly limited. Suitable carbon black will preferably have a particle size ranging form about 10-80 μm, preferably 20-40 nm.

Non-limiting examples of suitable carbon black are N110 (Vulcan® 9), N 219 (Regal® 600), N326 (Regale 300), N472 (Vulcan® XC-72 and its fluffy counterpart Vulcan® XC-72R), N539 (Sterling® SO-1), N550 (Sterling® SO), N762 (Sterling® NS-1), and N774 (Sterling® NS) all made by Cabot Corporation of Boston Mass. and Carbon black type SS6, SS4 and S170 from Degussa A G, Hanau-Wolfgang, Germany.

Prior to mixing with the carbon black, a sample of lubricating oil is oxidized according to CEC-L48-A-00. Typical conditions are, at a temperature of 140-160° C., for 72-96 hours, at an air flow rate of 5-10 L/hr.

Because an engine environment creates a shear effect, for example, by breaking apart viscosity modifiers which may be present in the sample, optionally, shear can be applied during the bench test using external mechanical means to mimic shear effect. Specifically, shear equipment which would have energy levels sufficient to break polymer chains of viscosity modifiers can be used. The required energy level depends on the viscosity modifier present in the sample. The shear can be applied physically by using steel balls as mill material and applying mechanical force to the samples, for example, using a Red Devil Paint Shaker 5400 Alternatively, a Kurt Orbahn device may be used to shear the sample by high velocity flow through a fixed orifice, which may be tuned for the particular viscosity modifier present in the sample. The shear application can occur before or immediately after measuring the viscosity of the sample, after preparing a stable sample/paste dispersion, or after equilibrating the stable sample/paste dispersion.

The dispersion is then transferred to a reverse flow viscometer and the viscosity of the dispersion is measured. Typical reverse flow viscometers include Cannon-Fenske Opaque viscometers and a Zeitfuchs #4 viscometer. Generally, prior to making the viscometric measurement, the temperature of the dispersion is equilibrated for 1 hours to 100° C. The results are generally reported as the difference in viscosity between the dispersion and the initial sample. The method for determining viscosity may be by conventional methods known to those of ordinary skill in the art, such as that described in U.S. Pat. No. 5,571,950.

Having generally described this invention, a further understanding can be obtained by reference to certain specific examples which are provided herein for purposes of illustration only and are not intended to be limiting unless otherwise specified.

EXAMPLES

Example 1

Synthesis of 20% DMAPMAm Copolymer

A comonomer mix of: 399 g of lauryl methacrylate, 100 g of N-[3-(dimethylamino)propyl]methacrylamide, and 1 g of cetyl-eicosyl methacrylate was prepared in an Erlenmeyer flask. To this comonomer mix was added 4.5 g of 1-dodecanethiol (Aldrich 98+%) chain transfer agent, and 1.5 g of a 25% solution of 2,2'-azobis[2-methylbutyronitrile] (DuPont's VAZO 67) initiator as a 25% solution in 2,6-dimethyl-4-heptanone (Aldrich 90+%.) Thirty weight percent (120 g) of the above mixture was added to a three liter, inert gas purged, four neck, round bottom flask with condenser attached. The heel charge was completed with the addition of 75 g of a 100N mineral oil solvent (SN100.) Maintaining a constant inert gas purge, the mixture was stirred and brought to reaction temperature of 95° C. Once at reaction temperature, the remaining comonomer and reactant mixture was added to the flask at a constant rate over ninety minutes, alternately heating and cooling as required to maintain 95+/−5° C. After this feed was complete, the reaction was held at 95° C. for thirty minutes. After the hold, an additional 5 g of a solution containing 2,2'-azobis[2-methylbutyronitrile] dissolved as a 25 wt % solution with 2,6-dimethyl-4-heptanone was prepared and mixed with 100 g of 100N mineral oil. This mixture was added at a constant rate over ninety minutes. At the end of the above feed, the reaction was held at 95° C. for an additional thirty minutes. At the end of the hold, an additional 400 g of 100N mineral oil was added and mixed thoroughly.

This procedure yielded 1086 g of a 46.5% active polymer solution.

Example 2

Synthesis of 10% DMAPMAm Copolymer

A procedure identical to that of Example 1 was used to prepare a 10% DMAPMAm copolymer, except that the charge of lauryl methacrylate was 449 g and the charge of N-[3-(dimethylamino)propyl]methacrylamide was 50 g.

Example 3

Synthesis of 7% DMAPMAm Copolymer

A procedure identical to that of Example 1 was used to prepare a 7% DMAPMAm copolymer, except that the charge of lauryl methacrylate was 464 g and the charge of N-[3-(dimethylamino)propyl]methacrylamide was 35 g.

Example 4a

Synthesis of 20% DMAEMA Copolymer

A procedure identical to that of Example 1 was used to prepare a 20% DMAEMA copolymer, except that 100 g of dimethylaminoethylmethacrylate was substituted for 100 g of N-[3-(dimethylamino)propyl]methacrylamide.

Example 4b

Synthesis of 20% MEMA Copolymer

A procedure identical to that of Example 1 was used to prepare a 20% MEMA copolymer, except that 100 g of morpholinoethylmethacrylate was substituted for 100 g of N-[3-(dimethylamino)propylmethacrylamide.

Example 5

Synthesis of 6% DMAEMA Copolymer

A procedure identical to that of Example 4a was used to prepare a 6% DMAEMA copolymer, except that the charge of lauryl methacrylate was 469 g, the charge of DMAEMA was 30 g.

Example 6

Synthesis of 4% NVP 3% DMAEMA Copolymer

A comonomer mix of:

35.3 g methacrylic acid ester of a branched $C_{12-15}$ alcohol mixture, 17.5 g methacrylic acid ester of a linear $C_{12-16}$ alcohol mixture, 0.3 g methacrylic acid ester of a linear $C_{12-20}$ alcohol mixture, 1.7 g of N,N Dimethylaminoethylmethacrylate (DMAEMA) was prepared in an Erleruneyer flask.

A 4.6 g portion of the above mixture, along with 41.7 g of neutral oil, was charged to a 250 ml liter 4-necked round bottomed flask equipped with stirrer, thermometer, reflux condenser, and metering line.

The mixture was inerted by bubbling nitrogen through the solution, and the reaction was started by addition of 0.06 g t-butyl-per-2-ethylhexanoate. The remaining monomer mixture (50.2 g) was metered into the reaction flask over a period of 3.5 hours at 100° C. After an additional 2 hours, 0.11 g t-butyl-per-2-ethylhexanoate was added. After another 2 hours, 1.3 g petroleum oil, 0.14 g of t-Butyl-per-benzoate and 2.2 g N-vinyl-pyrrolidinone were added to the reaction mixture. The reaction was held for another 4 hours with the addition of 0.07 g t-Butyl-per-benzoate every hour.

The procedure yielded 100 g of a 56.5% polymer solution.

Example 7

Synthesis of 4% NVP 3% TBAEMA Copolymer

A procedure identical to that of example 6 was used, except that t-butylaminoethylmethacrylate was substituted for dimethylaminoethylmethacrylate.

Example 8

Synthesis of 4% NVP 8% DMAPMAm Copolymer

A procedure identical to that of example 6 was used, except that 4.4 g of dimethylaminopropylmethacrylamide was substituted for 1.7 g of dimethylaminoethylmethacrylate.

Example 9

Synthesis of 4% NVP 3% DMAPMAm Copolymer

A procedure identical to that of example 6 was used, except that dimethylaminopropylmethacrylamide was substituted for dimethylaminoethylmethacrylate.

Example 10

Synthesis of 7% NVP Copolymer

A procedure identical to that of example 6 was used, except that dimethylaminoethylmethacrylate was omitted. The charge of N-vinyl pyrrolidinone was 3.9 g.

Example 11

Synthesis of 4% NVP 10% Styrene Copolymer

A comonomer mix of:

31.8 g methacrylic acid ester of a branched $C_{12-15}$ alcohol mixture, 15.8 g methacrylic acid ester of a linear $C_{12-16}$ alcohol mixture, 0.3 g methacrylic acid ester of a linear $C_{12-20}$ alcohol mixture, 5.23 g of styrene was prepared in an Erlenmeyer flask.

A 4.6 g portion of the above mixture, along with 41.7 g of neutral oil, was charged to a 250 ml liter 4-necked round bottomed flask equipped with stirrer, thermometer, reflux condenser, and metering line.

The mixture was made inert by bubbling nitrogen through the solution, and the reaction was started by addition of 0.06 g t-butyl-per-2-ethylhexanoate. The remaining monomer mixture (48.5 g) was metered into the reaction flask over a period of 3.5 hours at 100° C. After an additional 2 hours, 0.11 g t-butyl-per-2-ethylhexanoate was added. After another 2 hours, 1.3 g petroleum oil, 0.14 g of t-Butyl-per-benzoate and 2.2 g N-vinyl-pyrrolidinone were added to the reaction mixture. The reaction was held for another 4 hours with the addition of 0.07 g t-Butyl-per-benzoate every hour.

The procedure yielded 98 g of a 54.2% polymer solution.

Example 12

Synthesis of 10% Styrene 4% NVP 3% DMAPMAm Copolymer

A comonomer mix of:

31.8 g methacrylic acid ester of a branched $C_{12-15}$ alcohol mixture, 15.8 g methacrylic acid ester of a linear $C_{12-16}$ alcohol mixture, 0.3 g methacrylic acid ester of a linear $C_{12-20}$ alcohol mixture, 5.23 g of styrene, and 1.7 g of dimethylaminopropylmethacrylamide was prepared in an Erlenmeyer flask.

A 4.6 g portion of the above mixture, along with 41.7 g of neutral oil, was charged to a 250 ml liter 4-necked round bottomed flask equipped with stirrer, thermometer, reflux condenser, and metering line.

The mixture was made inert by bubbling nitrogen through the solution, and the reaction was started by addition of 0.06 g t-butyl-per-2-ethylhexanoate. The remaining monomer mixture (50.2 g) was metered into the reaction flask over a period of 3.5 hours at 100° C. After an additional 2 hours, 0.11 g t-butyl-per-2-ethylhexanoate was added. After another 2 hours, 1.3 g petroleum oil, 0.14 g of t-Butyl-per-benzoate and 2.2 g N-vinyl-pyrrolidinone were added to the reaction mixture. The reaction was held for another 4 hours with the addition of 0.07 g t-Butyl-per-benzoate every hour.

The procedure yielded 100 g of a 54.2% polymer solution.

Example 13

Synthesis of 10% Styrene 4% NVP 3% DMAEMA Copolymer

A procedure identical to example 12 was followed, except that DMAEMA was substituted for DMAPMAm.

Example 14

Synthesis of 10% Styrene 4% NVP 3% TBAEMA Copolymer

A procedure identical to example 12 was followed, except that TBAEMA was substituted for DMAPMAm.

Commercial Sample Example 15

Non-Dispersant Polyalkyl Methacrylate

A commercial sample of Viscoplex™ 8-702 was used.

Commercial Sample Example 16

Viscoplex™ 6-054

A commercial sample of Viscoplex™ 6-054 was used.

Commercial Sample Example 17

Viscoplex™ 6-954

A commercial sample of Viscoplex™ 6-954 was used.

Commercial Sample Example 18

Dispersant OCP: Hitec™ 5777

A commercial sample of Hitec™ 5777 (dispersant olefin copolymer) was used.

(2) Base Oil Formulation

As a typical example for a heavy duty diesel oil a 15W40 oil was formulated according to the following:

a) An oil with high viscosity (e.g. ESSO 600 N), 13-18 wt %;

b) An oil with low viscosity (e.g. ESSO 150 N), 61-65 wt %;

c) a typical DI-package (e.g. Oloa 4595), 10-15 wt %;

d) a non dispersing VII (e.g. OCP concentrate), 3-8 wt %;

e) a polymeric N-dispersant booster as described in the previous examples (2-8 wt %, referring to 1-4% active ingredient).

This base formulation was treated as described in (1), and the KV 100 before and after addition of 5 wt % carbon black was recorded to get a measure for the dispersing power of the polymer.

Evaluation Procedure:

1. A lubricating oil formulation of appropriate viscosity is formulated. Its viscosity (ηi) is measured in an Ubbelohde viscometer.

2. This sample is then oxidized according to procedure CEC-L48-A-00.

3. To the oxidized sample is added 5.0% of oven dried carbon black type S170 (Degussa A G, Hanau-Wolfgang, Germany).

4. The carbon black is dispersed in the medium via the aid of a ball mill under defined conditions.

5. The solution viscosity (ηf) is then measured in a reverse flow viscometer.

6. The change of viscosity in the presence of 5% carbon black is reported (ΔKV 100° C.)

Results

| | | Booster Backbone | | Dispersant Functionality | | | | | Δ KV |
|---|---|---|---|---|---|---|---|---|---|
| Example | % Booster | % PAMA | % Styrene | % NVP | % DMAPMAm | % DMAEMA | % TBAEMA | % MEMA | 100 C. |
| Example 1 | 3 | 80 | | | 20 | | | | 10.8 |
| Example 2 | 3 | 90 | | | 10 | | | | 12.9 |
| Example 3 | 3 | 93 | | | 7 | | | | 31.7 |
| Example 4a | 3 | 80 | | | | 20 | | | 13.6 |
| Example 4b | 3 | 80 | | | | | | 20 | 15.9 |
| Example 5 | 3 | 94 | | | | 6 | | | 28.1 |
| Example 6 | 3 | 93 | | 4 | | 3 | | | 17.0 |
| Example 7 | 3 | 93 | | 4 | | | 3 | | 16.6 |
| Example 8 | 3 | 88 | | 4 | 8 | | | | 15.7 |
| Example 9 | 3 | 93 | | 4 | 3 | | | | 24.5 |
| Example 10 | 3 | 93 | | 7 | | | | | 19.4 |
| Example 11 | 3 | 86 | 10 | 4 | | | | | 15.9 |
| Example 12 | 3 | 83 | 10 | 4 | 3 | | | | 13.3 |
| Example 13 | 3 | 83 | 10 | 4 | | 3 | | | 14.2 |
| Example 14 | 3 | 83 | 10 | 4 | | | | 3 | 13.3 |

| Example | % Booster | % PAMA | Δ KV 100 C. |
|---|---|---|---|
| Commercial Sample Example 15 Viscoplex ™ 8-702 | 3 | 100 | 82.4 |
| Commercial Sample Example 16 Viscoplex ™ 6-054 | 3 | 100 | 19.7 |
| Commercial Sample Example 17 Viscoplex ™ 6-954 | 3 | 100 | 23.7 |
| Commercial Sample Example 18 HITEC ™[1] 5777 | 4 | | 15.0 |

[1] From Afton Corp.

Based on reported results from actual engine tests, values of 15 or lower are consider predictive of "Passing" results. 15-20 are considered borderline results, and values greater than 20 are considered failures.

Obviously, numerous modifications and variations of the present invention are possible in light of the above teachings. It is therefore to be understood that within the scope of the appended claims, the invention may be practiced otherwise than as specifically described herein.

What is claimed is:

1. A method of operating a diesel engine provided with an exhaust gas recirculation system comprising lubricating said engine with a lubricating oil composition comprising:

a lubricating oil composition comprising:

(i) a polymeric dispersant booster comprising monomer units of:

a) 0 to 40 wt.% of one or more ethylenically unsaturated ester compounds of formula (I)

(I)

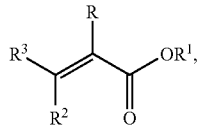

wherein R is equal to H or $CH_3$, $R^1$ represents a linear or branched alkyl group with 1 to 5 carbon atoms, $R^2$ and $R^3$ independently represent H or a group of the formula —COOR', wherein R' is H or an alkyl group with 1 to 5 carbon atoms, b) 80 to 98 wt.% of one or more ethylenically unsaturated ester compounds of formula (II)

(II)

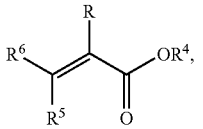

wherein R is equal to H or $CH_3$, $R^4$ represents a linear or branched alkyl group with 6 to 15 carbon atoms, $R^5$ and $R^6$ independently represent H or a group of the formula —COOR", wherein R" is H or an alkyl group with 6 to 15 carbon atoms, c) 0 to 30 wt.% of one or more ethylenically unsaturated ester compounds of formula (III)

(III)

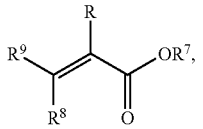

wherein R is equal to H or $CH_3$, $R^7$ represents a linear or branched alkyl group with 16 to 30 carbon atoms, $R^8$ and $R^9$ independently represent H or a group of the formula —COOR'", wherein R'" is H or an alkyl group with 16 to 30 carbon atoms, d) about 10 wt.% of at least one substituted styrene substituted with a substituent selected from the group consisting of halo-, amino-, alkoxy-, carboxy-, hydroxy-, sulfonyl- and $C_{1-12}$ hydrocarbyl, e) 4 to 7 wt.% of an N- dispersant monomer of at least one of N-vinylpyrrolidone and a dialkylaminoalkyl (meth)acrylate, wherein a)-e) add up to 100 wt.-%; and (ii) an oil of lubricating viscosity.

2. The method of operating a diesel engine of claim 1, wherein said polymeric N-dispersant booster is present in an amount of at least 1 wt. % based on the total weight of the oil composition.

3. The method of claim 1, wherein monomer b) comprises $C_{10-16}$methacrylate.

4. The method of claim 1, wherein said N-dispersant monomer is at least one selected from the group consisting of dimethylaminopropylacrylamide, dimethylaminoethylacrylamide, and tert-butyl aminoethylmethacrylate.

5. The method of claim 1, wherein said N-dispersant monomer is dimethylaminopropylacrylamide

6. The method of claim 1, wherein said N-dispersant monomer comprise N-vinylpyrrolidinone, in amounts of up to 5 wt.%.

7. The method of claim 1, wherein said polymeric dispersant booster has a number average molecular weight Mn of from 50,000-500,000.

8. The method of claim 1 wherein said polymeric dispersant booster has a shear stability of from 2-55 % as measure by the 30 cycle Kurt-Orbahn (Bosch diesel injector) test.

9. A diesel engine provided with an exhaust gas recirculation system comprising a lubricating oil composition comprising:

a lubricating oil composition comprising:

(i) a polymeric dispersant booster comprising monomer units of:

a) 0 to 40 wt.% of one or more ethylenically unsaturated ester compounds of formula (I)

(I)

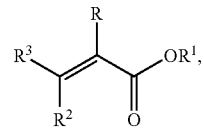

wherein R is equal to H or $CH_3$, $R^1$ represents a linear or branched alkyl group with 1 to 5 carbon atoms, $R^2$ and $R^3$ independently represent H or a group of the formula —COOR', wherein R' is H or an alkyl group with 1 to 5 carbon atoms, b) 80 to 98 wt.% of one or more ethylenically unsaturated ester compounds of formula (II)

(II)

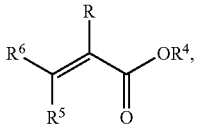

wherein R is equal to H or $CH_3$, $R^4$ represents a linear or branched alkyl group with 6 to 15 carbon atoms, $R^5$ and $R^6$ independently represent H or a group of the formula —COOR", wherein R" is H or an alkyl group with 6 to 15 carbon atoms, c) 0 to 30 wt.% of one or more ethylenically unsaturated ester compounds of formula (III)

(III)

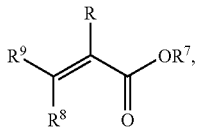

wherein R is equal to H or $CH_3$, $R^7$ represents a linear or branched alkyl group with 16 to 30 carbon atoms, $R^8$ and $R^9$ independently represent H or a group of the formula —COOR'", wherein R'" is H or an alkyl group with 16 to 30 carbon atoms, d) about 10 wt.% of at least one substituted styrene substituted with a substituent selected from the group consisting of halo-, amino-, alkoxy-, carboxy-, hydroxy-, sulfonyl-and $C_{1-12}$hydrocarbyl, e) 4 to 7 wt.% of an N- dispersant monomer of at least one of N-vinylpyrrolidone and a dialkylaminoalkyl (meth)acrylate, wherein a)-e) add up to 100 wt.-%; and (ii) an oil of lubricating viscosity.

* * * * *